US005884400A

United States Patent [19]

Elul

[11] Patent Number: 5,884,400

[45] Date of Patent: Mar. 23, 1999

[54] RAZOR AND GUIDE

[76] Inventor: Rafael Elul, P.O. Box 882941, San Francisco, Calif. 94188

[21] Appl. No.: 699,617

[22] Filed: Aug. 21, 1996

Related U.S. Application Data

[62] Division of Ser. No. 328,717, Oct. 24, 1994, Pat. No. 5,388,211.

[51] Int. Cl.[6] ..... B26B 19/38; B26B 19/02

[52] U.S. Cl. ..... 30/34.2; 30/43.9; 30/43.92

[58] Field of Search ..... 30/43.92, 48, 50, 30/34.2, 43.9, 43, 42, 346.5, 79

[56] References Cited

U.S. PATENT DOCUMENTS

| | | | |
|---|---|---|---|
| 1,785,189 | 12/1930 | Grisard | 30/48 |
| 2,043,851 | 9/1936 | Samuelson | 30/48 |
| 2,170,215 | 8/1939 | Rand, Jr. | 30/43 |
| 2,611,175 | 9/1952 | Kobler et al. | 30/43.92 X |
| 2,670,534 | 3/1954 | Haber | 30/34 |
| 2,726,445 | 12/1955 | Winther | 30/43 |
| 2,991,554 | 7/1961 | Somers et al. | 30/34 |
| 3,834,017 | 9/1974 | Tolmie | 30/34.2 |

FOREIGN PATENT DOCUMENTS

| | | | |
|---|---|---|---|
| 273657 | 10/1927 | United Kingdom | 30/48 |

*Primary Examiner*—Douglas D. Watts
*Attorney, Agent, or Firm*—Lyon & Lyon

[57] ABSTRACT

A razor that facilitates shaving effectiveness by effectively rendering the surface to be shaved taught. The razor comprises two or more surfaces wherein at least one of the surfaces is a cutting surface. The surfaces are inclined relative to each other, such that the skin and soft tissue in the area to be shaved is immobilized or pinched toward the cutting surface.

3 Claims, 12 Drawing Sheets

RAZOR AND GUIDE

This is a divisional of application Ser. No. 08/328,717, filed Oct. 24, 1994, now U.S. Pat. No. 5,388,211.

FIELD OF THE INVENTION

This invention relates to cutting devices and more particularly to manual and electric shaving devices that facilitate shaving effectiveness.

BACKGROUND OF THE INVENTION

In its most fundamental form, shaving involves a barber's hand-held single bladed classical straight razor. Shaving, however, is a dynamic process. The blade is not simply moved across a flat surface, cutting hair bristles as it glides over that surface. Nearly all surfaces shaved on the human body include soft tissue, muscles and fat, which underly the skin to be shaved. The surfaces to be shaved, without exception, are not flat, but rather constitute a section of arcuate, moveable surfaces. Effective shaving, therefore, requires that the skin be immobilized so that a moving blade can shear hair off. This is accomplished by pinching, stretching, or pressing with the shaver's (or the barber's) other hand until the skin is rendered taut.

The existing designs of shavers are not very effective in immobilizing skin and tissue as required for effective shaving. The least effective in immobilizing skin is the classical straight razor. This classical razor uses a planar cutting surface which results in an area of contact, between the cutter and the tissue to be shaved, that is quite limited. Moreover, in such a configuration the cutter has no capability of restraining or immobilizing the skin and tissue. For this reason, the classical razor has been largely supplanted by the "safety" razor.

The "safety," or conventional, razor has built in skin immobilization by means of a passive sliding plate or support (sometimes incorporating rollers) situated parallel to the cutting surface at a distance of 0.5 to 1.0 mm from the cutting edge. All such designs are characterized by the parallel orientation of the cutter blade and support plate. In actual operation, this plate does produce some skin immobilization and stretching. However, the skin immobilization is inherently inefficient, requiring stretching with the shaver's other hand or some other method of rendering the skin to be shaved taut.

Similarly, the design of conventional electric razors is hampered by their inherently inefficient, or lack of, immobilization of the skin. The basic current design of electric razors typically includes one moving blade and a second parallel stationary surface comprising a screen mesh or slotted plate. In operation the hair is trapped between the stationary surface and the moving blade, and sheared off with little or no immobilization of the skin.

Therefore, it would be desirable to have a shaving device that is capable of improved immobilization of the skin, in comparison with conventional shaving devices, to facilitate shaving effectiveness such as closeness, and that is capable of improved contact with an arcuate surface to also facilitate shaving effectiveness and speed.

SUMMARY OF THE INVENTION

The razor of the present invention serves to facilitate shaving effectiveness by substantially rendering the surface to be shaved taut. According to an exemplary embodiment of the present invention, the razor preferably includes two or more surfaces wherein at least one of the surfaces is a cutting surface. The surfaces are not parallel, but inclined or angled relative to each other, such that the skin and soft tissue in the area to be shaved is trapped between them, and as a consequence is immobilized or pinched towards the cutting surface.

An object of this invention is to provide an improved razor.

Further objects and advantages of the present invention will become apparent from a consideration of the drawings and ensuing description.

DESCRIPTION OF THE PRIOR ART

Figure 1:
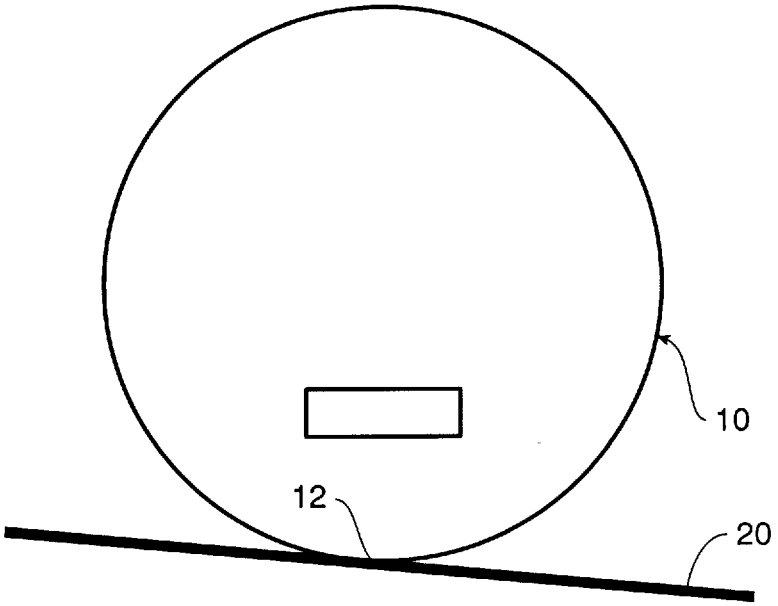
FIG. 1 Prior Art
FIG. 1 is a diagram of a classical razor of the prior art in which a single cutting plane is used to address the tissue surface to be shaved.
Figure 2:
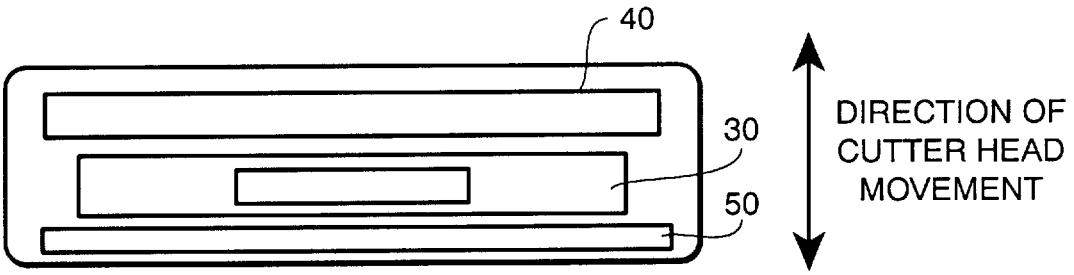
FIG. 2 Prior Art
FIG. 2 is a diagrammatic cross-sectional view of a "safety", or conventional manual, razor cutting head assembly of the prior art.
Figure 3:
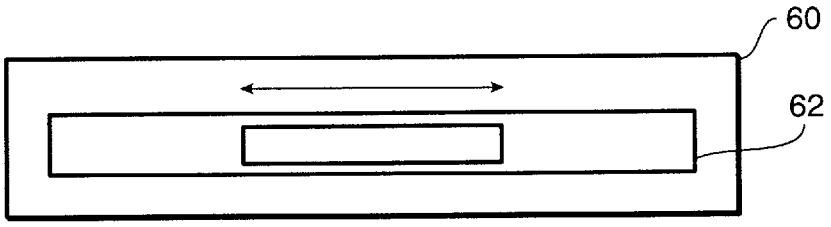
FIG. 3 Prior Art
FIG. 3 is a diagrammatic top view of a conventional electric razor cutting head assembly of the prior art.

Referring now in detail to the drawings, FIGS. 1–3, as noted above, illustrate prior art razors.

Effective shaving requires that the skin be immobilized so that hair can be sheared off by a moving blade. However, razors incorporating a classical razor concept that comprises merely a single planar cutting surface 20, diagrammatically shown in FIG. 1, are incapable of restraining or immobilizing the skin and soft tissue 10. Such a configuration results in an area of contact 12, between the cutting surface 20 and skin and soft tissue 10, that is quite limited, resulting in a configuration that is incapable of immobilizing the skin and soft tissue 10.

Referring to FIG. 2, the same shows a diagrammatic cross-sectional view of a "safety," or conventional manual, razor cutting head assembly incorporating the classical razor concept of FIG. 1. Typically, the conventional razor comprises a blade, or cutting surface 30, an adjacent support, or slider, plate 40, and a guide 50. Sometimes the conventional razor incorporates rollers or similar devices (not shown) in place of the slider plate 40. All such configurations are characterized by the parallel orientation of the blade 30, the support plate 40, and the guide 50. Thus, in operation the conventional razor configuration is hampered by the inherently inefficient, or lack of, immobilization of the skin and soft tissue 10, as noted in regard to the classical razor configuration shown in FIG. 1. As a result, this configuration requires further stretching of the skin and soft tissue 10 with the shaver's other hand, or some other method to immobilize the skin and soft tissue 10, to render the shaving surface taut in order to achieve an effective shave.

Similarly, conventional electric razors incorporating the classical razor concept of FIG.1 are also inherently inefficient in immobilizing the skin and soft tissue to be shaved. Referring to FIG. 3, the same shows a schematic top view of a conventional cutter head assembly for an electric shaving device. Electric shavers normally incorporate a two component cutter 60, 62, effectively functioning as a miniature scissors. Typically, there is a moving blade 62 and a stationary surface 60. The stationary surface 60 is usually a screen mesh or slotted plate of some sort. The hair is generally trapped between the stationary surface 60 and the moving blade 62, and sheared off with the help of little or no skin immobilization.

DESCRIPTION OF THE PREFERRED EMBODIMENT

Figure 4:
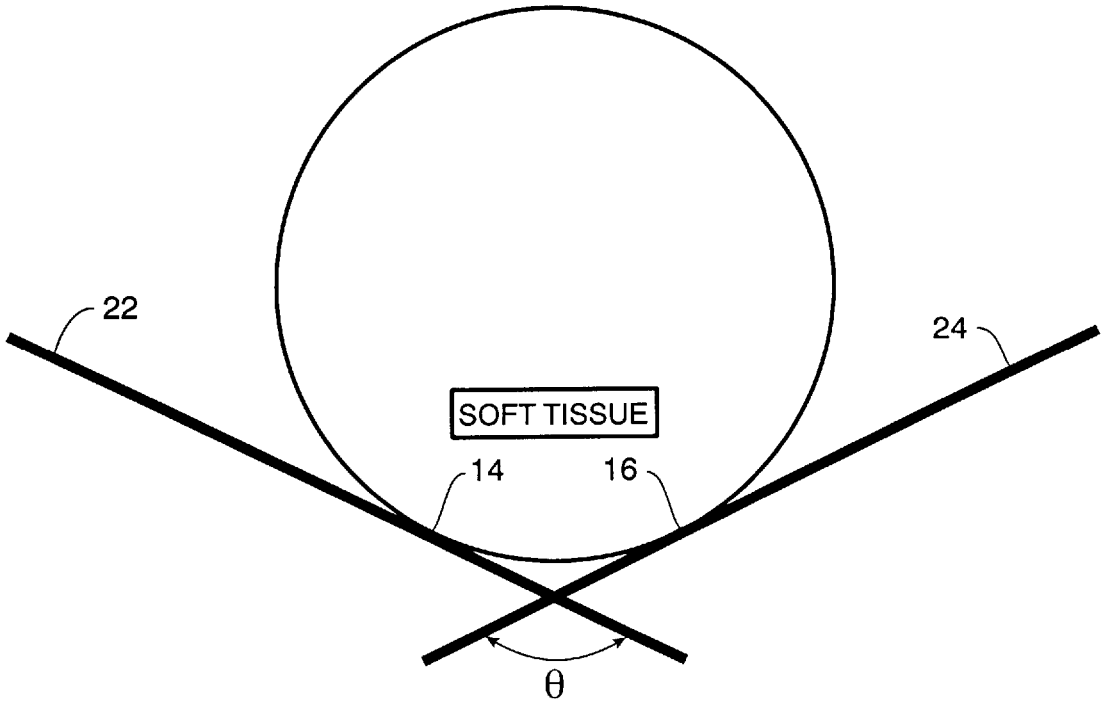
FIG. 4 is a diagram of the razor concept of the present invention in which a plurality of intersecting planes, one or more cutting, are used to address the surface to be shaved.

Referring now to FIGS. 4–13, there is illustrated a novel razor that facilitates shaving effectiveness. Referring to FIG. 4, the same shows diagrammatically the novel razor concept of the present invention comprising two, or more, intersecting planar surfaces 22 and 24, inclined relative to one another at an angle θ. This razor configuration results in greater areas of contact, 14 and 16, with the skin and soft tissue 10, thus resulting in improved immobilization of the skin and soft tissue 10 in between 14 and 16 over the classical razor configuration shown in FIG. 1.

The effectiveness of shavers incorporating the razor concept is especially increased because the skin area shaved, as a rule, overlies areas of fatty tissue or muscle. The inclined surfaces provide a better grip on the skin and soft tissue 10, similar to the cupped palm of a hand gripping a softball. When the palm of the hand is extended until it is substantially flat, it is nearly impossible to grip the ball or, as with a razor, immobilize a spherical surface by contact with a single plane. However, as soon as the palm of the hand is cupped, the ball can be gripped and handled. A second plane inclined to the plane of the blade, as with the razor of the present invention as shown in FIG. 4, accomplishes essentially the same outcome as cupping one's hand, such that the skin and soft tissue 10 is immobilized or pinched toward a cutting surface, 22 and/or 24. This immobilization of the skin and soft tissue 10 is achieved regardless of whether both surfaces 22 and 24 are actually blades, or whether one surface is a blade and the other surface is a passive sliding support plate.

Figure 5A:
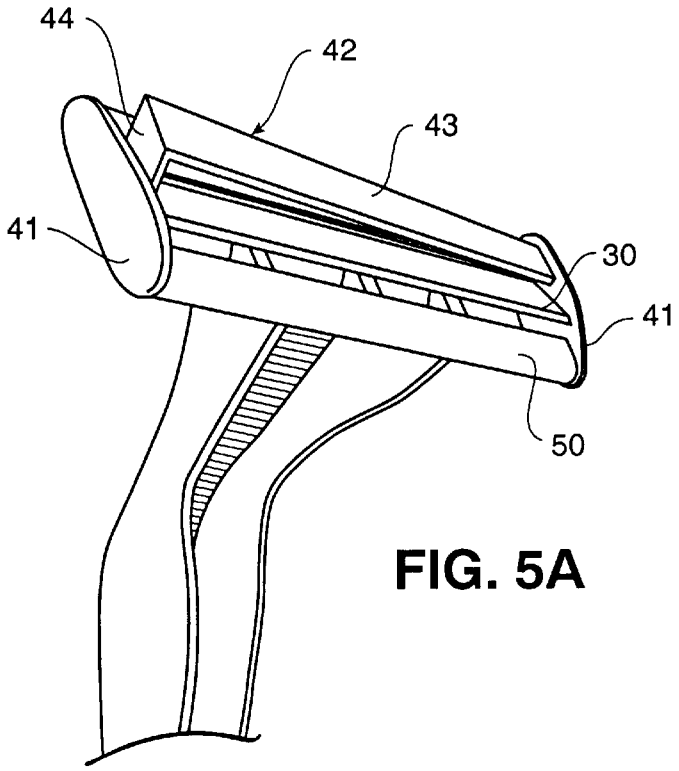
FIGS. 5A and 5B are perspective views of a novel manual razor cutting head assembly according to the present invention.
Figure 5B:
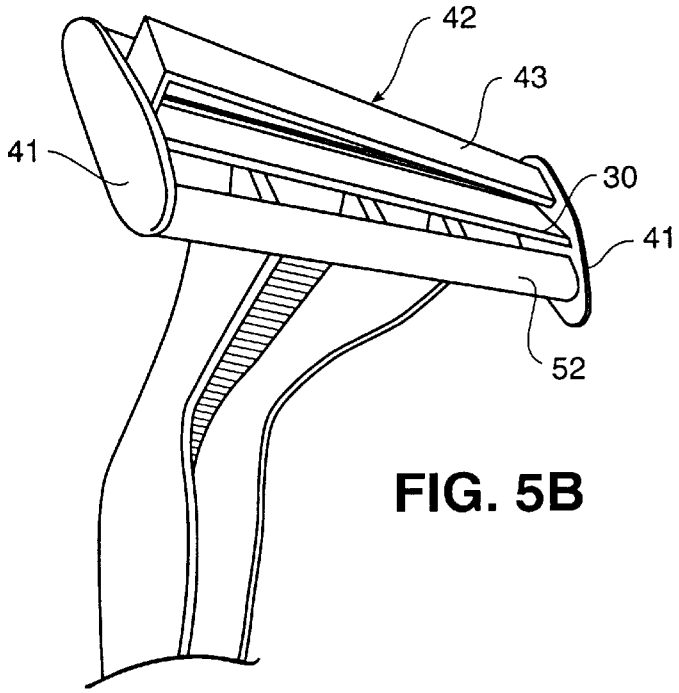

The razor concept of the present invention, as shown in FIG. 4, can readily be incorporated into a manual or electric shaving device. Accordingly the same immobilizing effect exhibited by the razor configuration depicted in FIG. 4, can be achieved if the support 40 of the conventional manual razor in FIG. 2 were inclined relative to the razor's blade 30, as shown in FIG. 5A, and enhanced if the guide 50 of the conventional manual razor in FIG. 2 were also inclined relative to the razor's blade 30, as shown in FIG. 5B. Although, it is preferrable that a manual razor embodiment of the present invention, as illustrated in FIG. 5B, have two planes 43,52 inclined relative to the blade 30 to immobilize the skin and tissue relative to the blade 30, a manual razor embodiment of the present invention, as illustrated in FIG. 5A, having only a single plane 43 inclined relative to the blade, accomplishes essentially the same effect of immobilizing the skin relative to the blade.

Figure 6:
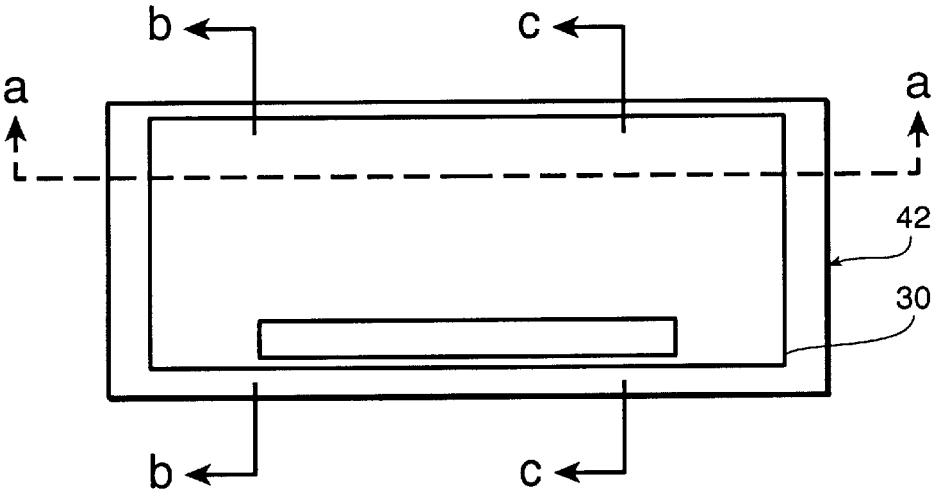
FIG. 6 is a diagrammatic top view of the manual razor cutting head assembly in FIG. 5A.
Figure 6A:
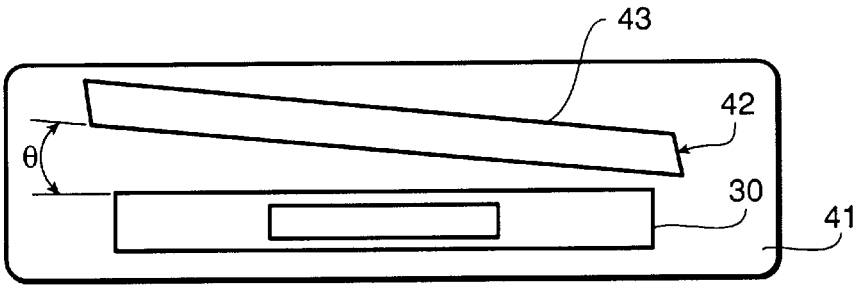
FIG. 6A is a diagrammatic cross-sectional view of the manual razor cutting head assembly taken along a line a—a in FIG. 6.
Figure 6B:
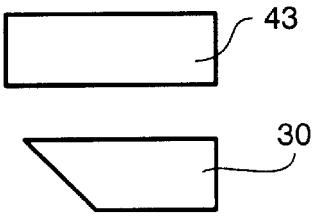
FIG. 6B is a diagrammatic cross-sectional view of the manual razor cutting head assembly taken along a line b—b in FIG. 6.
Figure 6C:
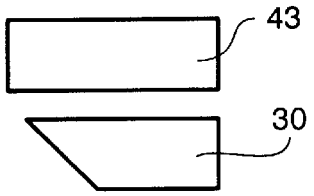
FIG. 6C is a diagrammatic cross-sectional view of the manual razor cutting head assembly taken along a line c—c in FIG. 6.

Referring to FIGS. 5A and 6–6C, the razor cutting head assembly is shown to incorporate the razor concept of the present invention. The razor cutting head assembly comprises a blade 30, a guide 50, and a support 42 having a slider plate 43. The longitudinal axis of the slider plate 43 is positioned at an angle θ relative to the longitudinal axis of the blade 30 in a single plane parallel to the page and to the direction of travel of the blade 30. The slider plate 43 attaches to a blade holder 41 at one end and to a support arm 44 at the other end. The support arm 44 extends from the blade holder 41 and may be made adjustable to allow adjustment of the angle θ between the slider plate 43 and the blade 30. This embodiment results in a gap between the slider plate 43 and the blade 30 that is wide at one end of the razor cutting head assembly and is narrow at the other end of the razor cutting head assembly. This embodiment essentially accomplishes the desired immobilization or pinching of the skin and soft tissue 10 toward the blade 30 that is achieved by the razor configuration depicted in FIG. 4.

Figure 6D:
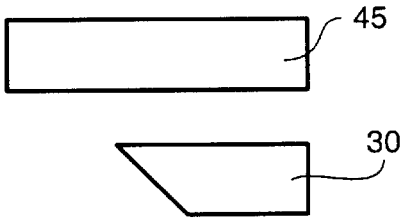
FIG. 6D is a variant of the cross-sectional view of the manual razor cutting head assembly in FIG. 6B taken along a line b—b in FIG. 6.
Figure 6E:
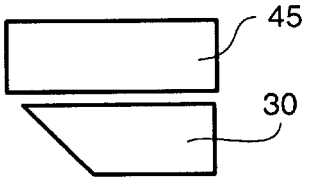
FIG. 6E is a variant of the cross-sectional view of the manual razor cutting head assembly in FIG. 6C taken along a line c—c in FIG. 6.

A variant of the embodiment described and depicted in FIGS. 5A and 6–6C, as shown in FIGS. 6D–6E, comprises a slider plate 45 and a blade 30. The slider plate 45 is angled relative to the blade 30 at the same angle θ as the slider plate 43 is angled to the blade 30 in FIG. 6A. However, the slider plate 45 is beveled such that it is narrower on one end than the other end. The wider end of the slide plate 45 is also the furthest end from the blade 30 as shown in FIGS. 6D and 6E. The beveled edge of the slider plate 45 simulates positioning the slider plate 45 at a second angle along its longitudinal axis relative to the blade 30. Thus, this embodiment also accomplishes the desired immobilization effect.

Figure 7:
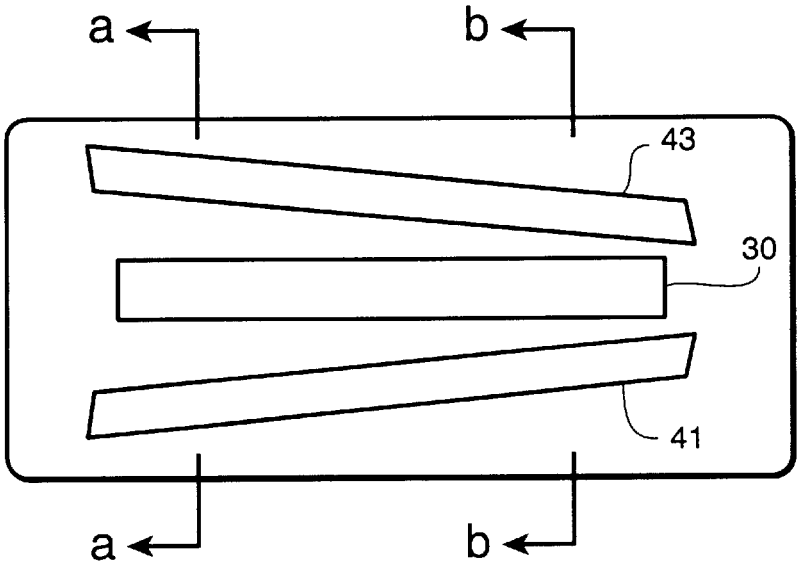
FIG. 7 is a diagrammatic cross-sectional view of the manual razor cutting head assembly taken along a line a—a in FIG. 6 with FIG. 6 being a diagrammatic top view of the manual razor cutting head assembly in FIG. 5B.
Figure 7A:
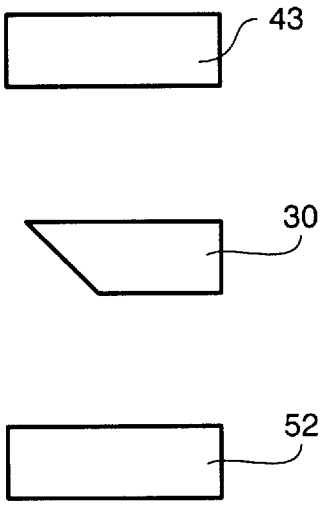
FIG. 7A is a diagrammatic cross-sectional view of the manual razor cutting head assembly taken along a line a—a in FIG. 7.
Figure 7B:
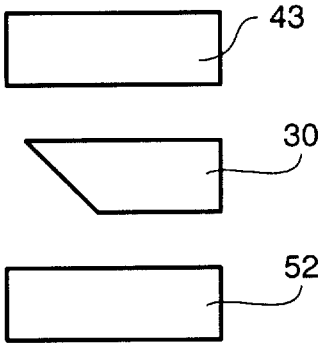
FIG. 7B is a diagrammatic cross-sectional view of the manual razor cutting head assembly taken along a line b—b in FIG. 7.

Referring to FIGS. 5B and 7–7B, the razor cutting head assembly of the preferred manual razor embodiment of the present invention is similarly shown to incorporate the razor concept of the present invention. The razor cutting head assembly comprises a blade 30, a support 42 having a slider plate 43, and a guide 52. As in the previous embodiment, the longitudinal axis of the slider plate 43 is positioned at an angle θ relative to the longitudinal axis of the blade 30 in a single plane parallel to the page and to the direction of travel of the blade 30. The longitudinal axis of the guide 52 is also positioned at an angle Φ relative to the longitudinal axis of the blade 30 in a single plane parallel to the page and to the direction of travel of the blade 30. The slider plate 43 attaches to the blade holder 41 and the other end attaches to the support arm 44 that extends from the blade holder 41. The guide 52 attaches to the blade holder 41 on one and a support arm (not shown) or the blade holder 41 on the other end. The support arms may be adjustable to allow adjustment of the angles θ and Φ, respectively, between the blade 30 and the slider plate 43 and the guide 52, respectively. This embodiment results in a gap above and below the blade 30 that is between the blade 30 and the slider plate 43, and the blade 30 and the guide 52, respectively. The gaps are wide at one end of the razor cutting head assembly and are narrow at the other end of the razor cutting head assembly. This embodiment essentially accomplishes the desired immobilization or pinching of the skin and soft tissue 10 toward the blade 30 that is achieved by the razor configuration depicted in FIG. 4.

Figure 8:
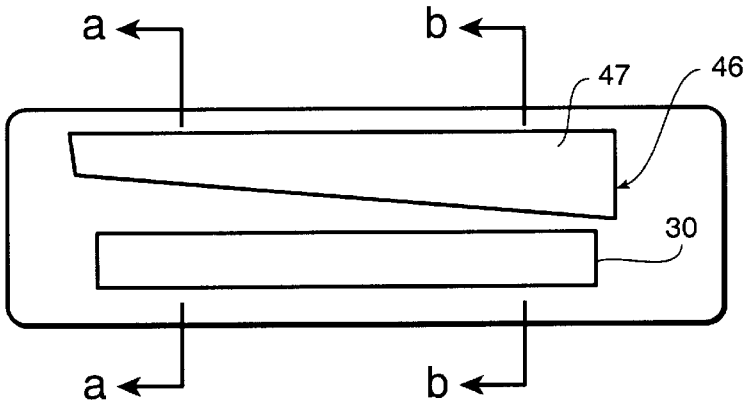
FIG. 8 is a variant configuration of the schematic cross-sectional view of the manual razor cutting head assembly in FIG. 6A.
Figure 8A:
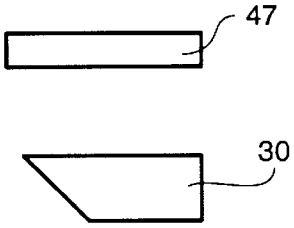
FIG. 8A is a diagrammatic cross-sectional view of the manual razor cutting head assembly taken along a line a—a in FIG. 8.
Figure 8B:
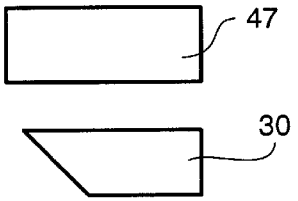
FIG. 8B is a diagrammatic cross-sectional view of the manual razor cutting head assembly taken along a line b—b in FIG. 8.

Variants of the embodiments described and depicted in FIGS. 5A and 6–6C and 5B and 7–7C, respectively, are shown in FIGS. 8–8B and 8C–8D, respectively. Referring to FIGS. 8–8B, the variant embodiment depicted therein comprises a blade 30 and a support 46 having a slider plate 47 positioned parallel to the blade. The slider plate 47, however, is beveled such that it is narrower on one end than on the other. The beveled edge of the slider plate 47 simulates the positioning, shown in FIGS. 5A and 6–6B, of the slider plate 43 at an angle relative to the blade 30. Thus, these embodiments also accomplishes the desired immobilization effect.

Figure 8C:
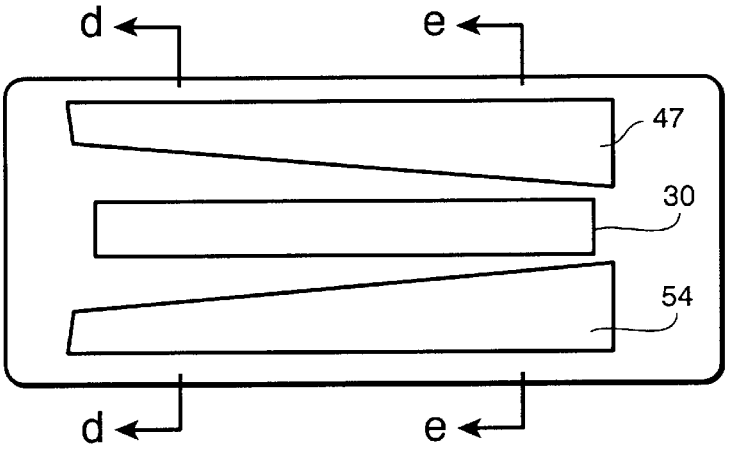
FIG. 8C is a variant configuration of the schematic cross-sectional view of the manual razor cutting head assembly in FIG. 7.
Figure 8D:
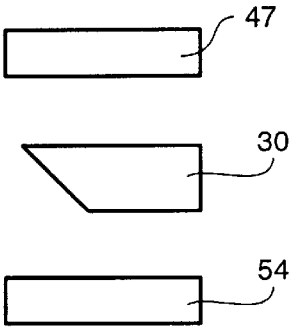
FIG. 8D is a diagrammatic cross-sectional view of the manual razor cutting head assembly taken along a line d—d in FIG. 8C.
Figure 8E:
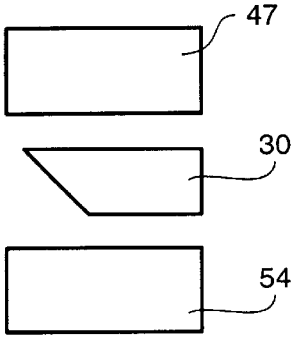
FIG. 8E is a diagrammatic cross-sectional view of the manual razor cutting head assembly taken along a line e—e in FIG. 8C.

Referring to FIGS. 8C–8E, the variant embodiment depicted therein further refines the embodiment depicted and described in FIGS. 8–8B. The embodiment comprises a blade 30, a slider plate 47 and a guide 54 positioned in parallel relation to one another. However, the slider plate 47 and the guide 54 are beveled such that they are narrower on one end than the other. The beveled edge of the slider plate 47 and the guide 54 simulates the positioning, shown in FIGS. 5B and 7–7B, of the slider plate 43 and the guide 53 at an angle relative to the blade 30, and accomplishes the desired immobolization effect.

Similar results can be achieved in an embodiment that incorporates the novel razor concept of the present invention into an electric shaving device. As noted in regard to FIG. 3, the conventional electric razor comprises a moving blade 62 and a stationary surface 60. However, the effectiveness of this configuration is improved by adding one or more stationary surfaces which are inclined relative to the cutting head, as shown in FIG. 9.

Figure 9:
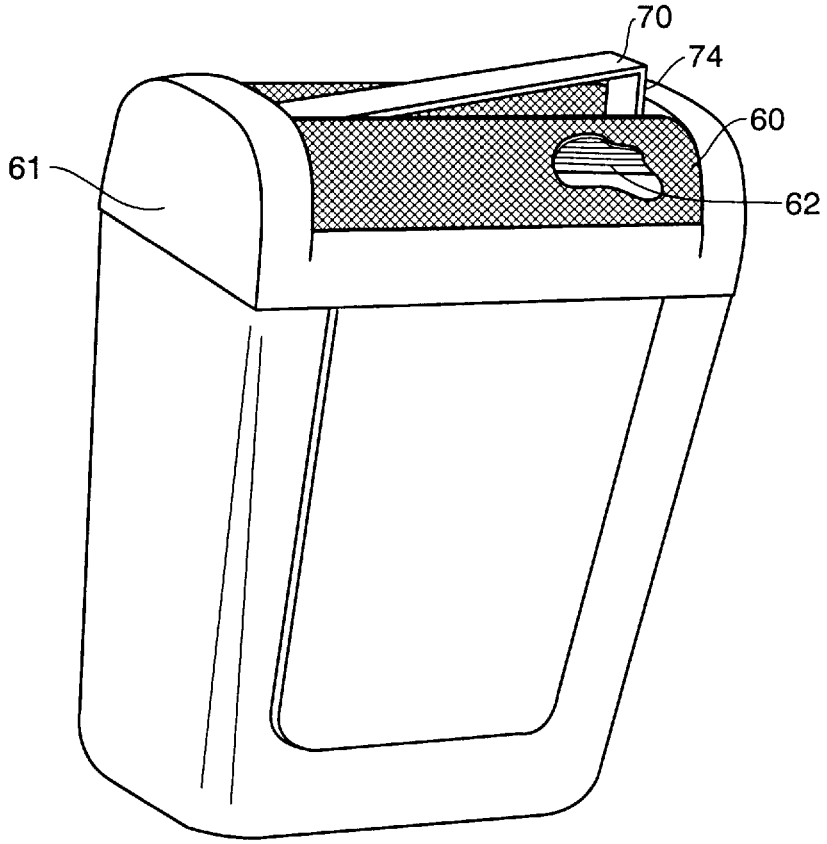
FIG. 9 is a perspective view of a novel electric razor cutting head assembly according to the present invention.
Figure 10:
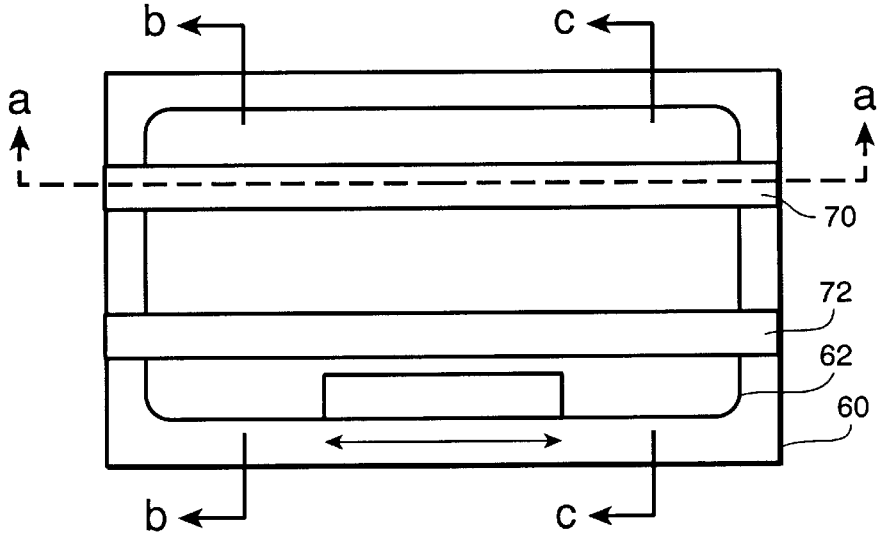
FIG. 10 is a diagrammatic top view of the electric razor cutting head assembly in FIG. 9.
Figure 10A:
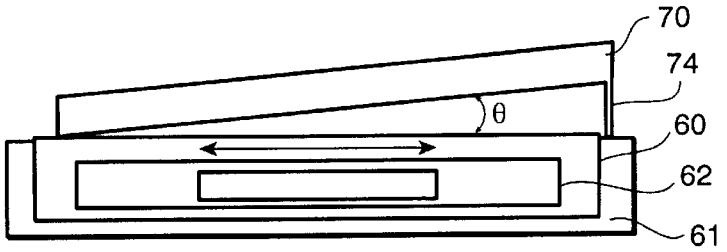
FIG. 10A is a diagrammatic cross-sectional view of the electric razor cutting head assembly taken along a line a—a in FIG. 10.
Figure 10B:
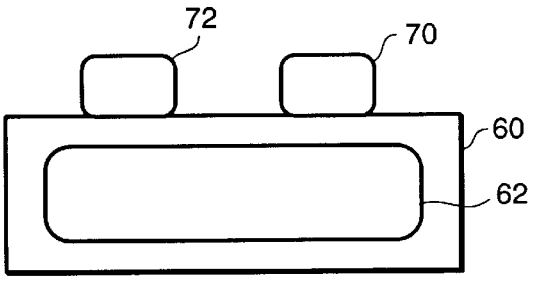
FIG. 10B is a diagrammatic cross-sectional view of the electric razor cutting head assembly taken along a line b—b in FIG. 10.
Figure 10C:
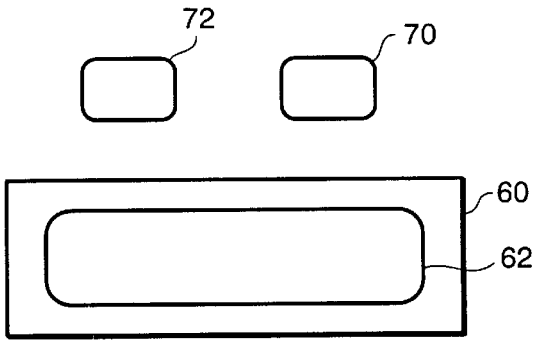
FIG. 10C is a diagrammatic cross-sectional view of the electric razor cutting head assembly taken along a line c—c in FIG. 10.

Referring to FIGS. 9 and 10–10C, the electric razor cutting head assembly of the present invention comprises one or more spacer pads 70 and 72 that are inclinely attached to the razor body 61 at one end and to a support arm(s) 74 extending from the razor body 61 at the other end. The spacer pads 70 and 72 are inclined along their longitudinal axes at an angle θ (in a plane parallel to the plane of the page) relative to the longitudinal axes of the stationary surface 60 and the moving blade 62. The support arm(s) 74 may be adjustable to allow adjustment of the angle θ between the spacer pads 70 and 72 and the stationary surface 60 and the moving blade 62. Thus, this embodiment is able to accomplish the same desirable effect of causing the skin and soft tissue 10 to be immobilized, or be pinched toward the cutting assembly head as the razor is moved in a direction perpendicular to the plane of the page in regard to FIG. 10A, and in a semi-rotational manner about an axis of rotation that is perpendicular to the page in regard to FIGS. 10B and 10C.

Figure 12:
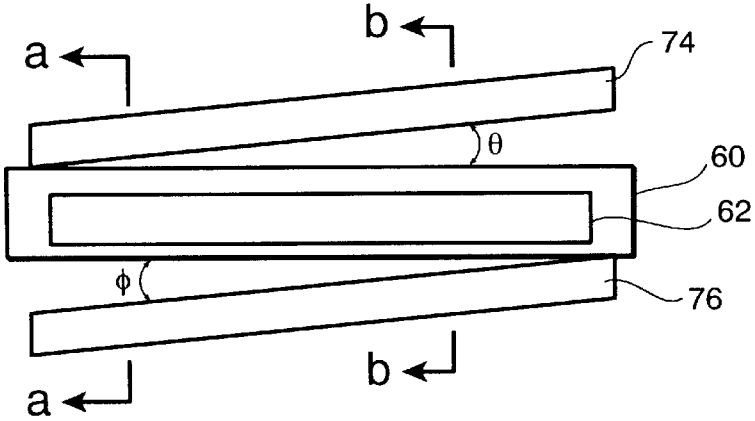
FIGS. 11 and 12 are diagrammatic top views of variant configuration of the electric razor cutting head assembly in FIG. 9.
Figure 12B:
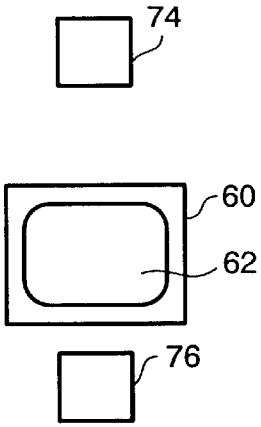
FIG. 12B is a diagrammatic cross-sectional view of the electric razor cutting head assembly taken along a line b—b in FIG. 12.
Figure 12A:
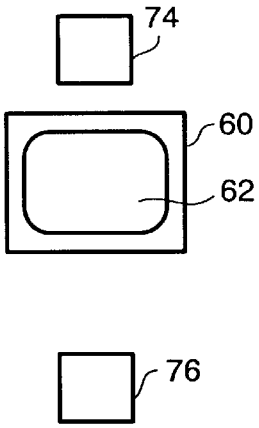
FIG. 12A is a diagrammatic cross-sectional view of the electric razor cutting head assembly taken along a line a—a in FIG. 12.
Figure 11:
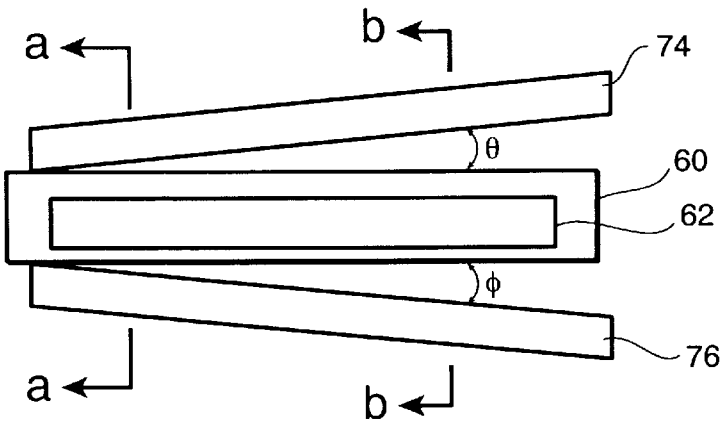
Figure 11B:
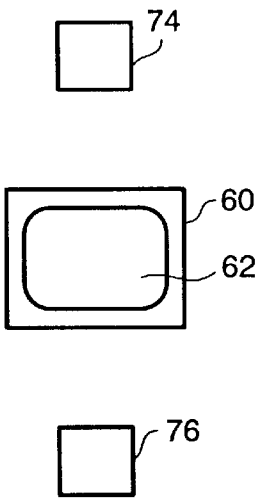
FIG. 11B is a diagrammatic cross-sectional view of the electric razor cutting head assembly taken along a line b—b in FIG. 11.
Figure 11A:
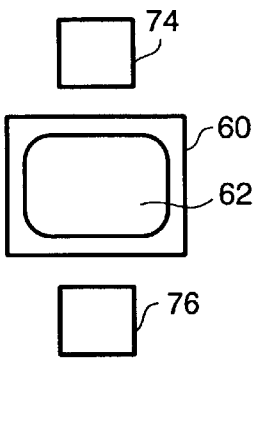
FIG. 11A is a diagrammatic cross-sectional view of the electric razor cutting head assembly taken along a line a—a in FIG. 11.

Variants on this embodiment, as shown in FIGS. 11–12B, comprise spacer pads 74 and 76 that are angled along their longitudinal axes at angles Φ and θ outwardly in the plane of the page from the stationary surface 60 and the moving blade 62. Thus, this embodiment is also able to accomplish the same desirable effect of causing the skin and soft tissue 10 to be immobilized, or be pinched toward the cutting assembly head.

Figure 13:
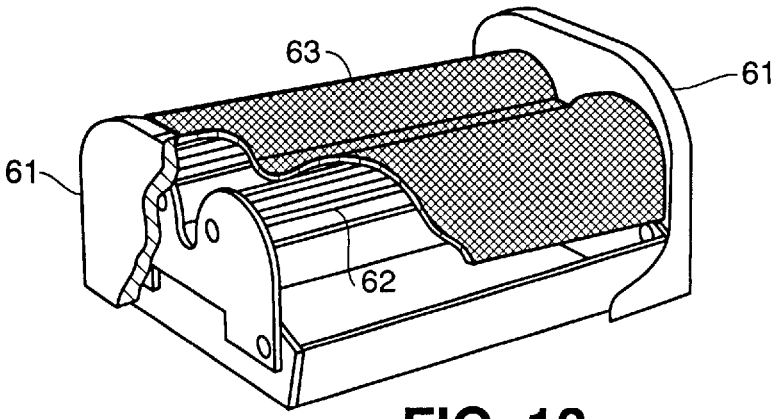
FIG. 13 is a perspective view of a variant configuration of the electric razor cutting head assembly in FIG. 9 and according to the present invention.
Figure 13A:
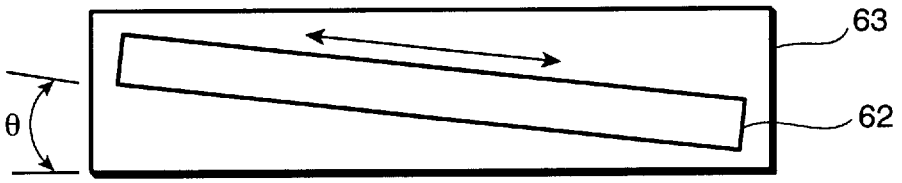
FIG. 13A is a diagrammatic front view of the electric razor cutting head assembly in FIG. 13.

The same immobilizing effect is also achieved in somewhat different embodiments that are novel variants on the conventional electric razor configuration depicted in FIG. 3. Referring to FIGS. 13 and 13A, one variant embodiment angles the stationary surface 63 along its longitudinal axis relative to the longitudinal axis of the moving blade 62 at an angle θ, such that the stationary surface 63 attaches to a blade holder 61 at a higher point on one end and a lower point on the other end. Another variant embodiment, as seen when referring to FIGS. 14 and 14A, would be a system comprised of two or more moving blades 64 and 66 that are both angled relative to one another and a stationary surface 60 along their respective transverse axes, or relative to a stationary support (not shown).

Figure 14:
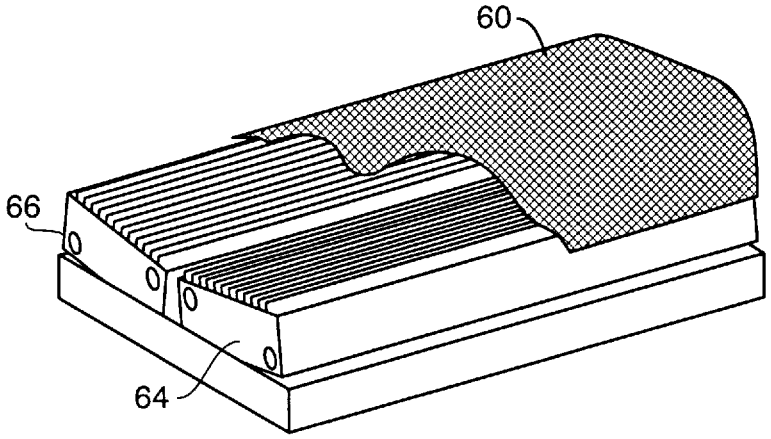
FIG. 14 is a perspective view of another variant configuration of the electric razor cutting head assembly in FIG. 8 and according to the present invention.
Figure 14A:
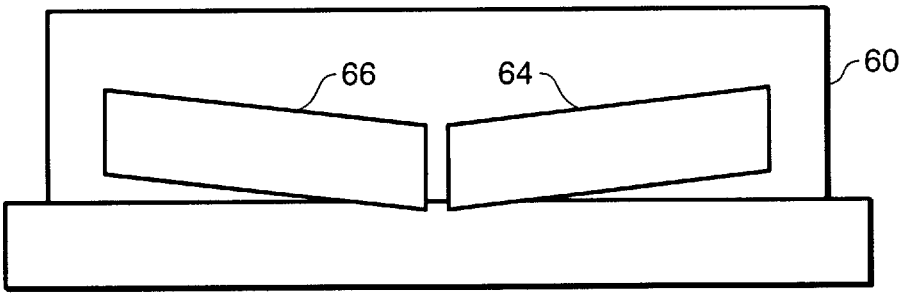
FIG. 14A is a diagrammatic end view of the electric razor cutting head assembly in FIG. 14.
Figure 15:
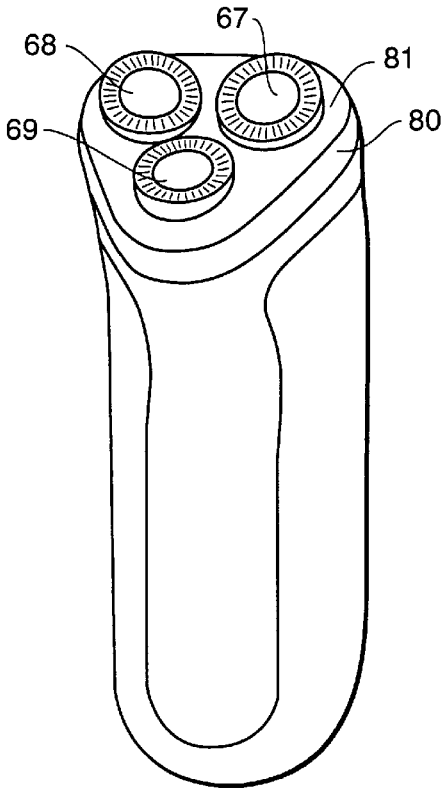
FIG. 15 is a perspective view of a novel electric razor rotary cutting head assembly according to the present invention.
Figure 15A:
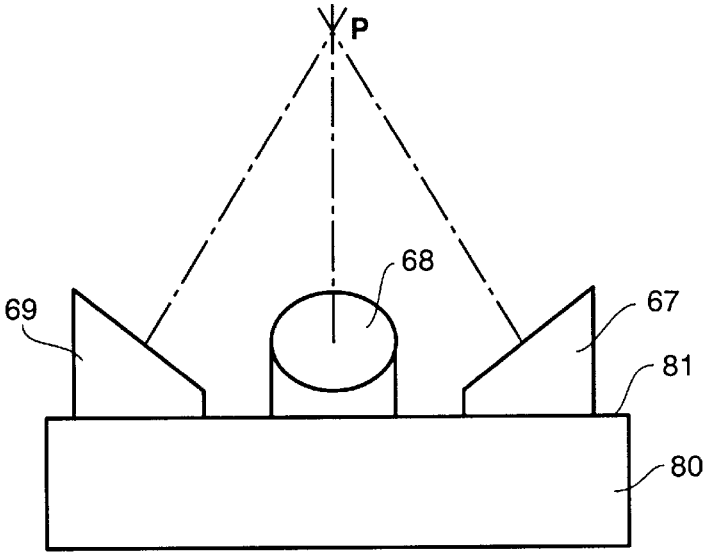
FIG. 15A is a diagrammatic side view of the electric razor cutting head assembly in FIG. 15.

A further embodiment, similar to that depicted and described in FIGS. 14 and 14A, is shown in FIGS. 15 and 15A incorporating the razor concept of the present invention to a rotary head electric razor. As with the conventional rotary head electric razor, this embodiment of the present invention, for exemplary purposes only, comprises three rotatable circular cutting rotors 67, 68, and 69, respectively. The number of rotors may be more or less than three. The heads 67, 68, and 69, however, are fixedly inclined relative to one another and the face 81 of the razor head 80, such that the axes of rotation of the heads 67, 68, and 69, respectively, converge at a point P in space above the face 81 of the razor head 80. Thus, this embodiment of the present invention achieves the most direct realization of the "cupped hand" skin and tissue immobilization concept of the present invention. Therefore, this embodiment is able to accomplish the same desirable effect of causing the skin and soft tissue to be immobilized, or be pinched toward the cutting head assembly.

While the above description contains many specificities, these should not be construed as limitations on the scope of the invention, but rather as an exemplification of one preferred embodiment thereof. Other variations are possible.

Accordingly, the scope of the present invention should be determined not by the embodiments illustrated above, but by the appended claims and their legal equivalents.

What is claimed is:

1. An electric razor comprising an elongated blade having a longitudinal axis, a blade holder interconnected to said blade an elongated member interconnected to said blade, said blade being movable relative to said member, said member having a slider plate fixedly inclined at an angle Θ relative to the longitudinal axis of said blade and forming an elongated gap therebetween said slider plate having a first end and a second end, the first end being attached to said blade holder, and a support arm extending from said blade holder and attached to the second end of said slider plate.

2. The electric razor of claim 1, further comprising an elongated second member interconnected to said blade, said second member having a surface fixedly inclined at an angle ϕ relative to the longitudinal axis of said blade and forming an elongated space therebetween.

3. The electric razor of claim 2, wherein said slider plate of said member and said second member being adjustable to fixed positions and wherein at least one of the angles Θ or ϕ being greater than zero.

* * * * *